United States Patent [19]

Zaoui

[11] 3,938,196

[45] Feb. 17, 1976

[54] TROUSERS

[76] Inventor: Raymond Zaoui, 11 rue Le Vau, Paris, France

[22] Filed: Nov. 9, 1973

[21] Appl. No.: 414,325

[30] Foreign Application Priority Data

May 29, 1973 France ..... 73.19442

[52] U.S. Cl. ..... 2/227; D2/28

[51] Int. Cl.[2] ..... A41D 1/10

[58] Field of Search ..... 2/227, 243 R, 79, 232; D2/28

[56] References Cited

UNITED STATES PATENTS

| | | | |
|---|---|---|---|
| 540,182 | 5/1895 | McGrady | 2/227 |
| 890,792 | 6/1908 | Peine | 2/227 |
| 1,791,220 | 2/1931 | Mueller | 2/227 X |
| 2,360,018 | 10/1944 | Rouse | 2/227 |
| D172,738 | 8/1954 | Belden | D2/28 |
| D217,082 | 4/1970 | Koenig | 2/227 X |
| D230,909 | 3/1974 | Avrich | 2/227 X |
| D230,910 | 3/1974 | Avrich | D2/28 |

FOREIGN PATENTS OR APPLICATIONS

| | | | |
|---|---|---|---|
| 2,011,820 | 10/1970 | Germany | 2/227 |

*Primary Examiner*—H. Hampton Hunter
*Attorney, Agent, or Firm*—Hill, Gross, Simpson, Van Santen, Steadman, Chiara & Simpson

[57] ABSTRACT

For increased comfort and durability of appearance, each leg of a pair of trousers is provided with a plurality of ribbed creases extending generally longitudinally along its periphery.

1 Claim, 13 Drawing Figures

1
2
2a
2b
3
3a
3b
4
5
6
7
8
9
10
11
12
14
15
16
17
18
19
20
21
III
V

IX
VII 40
41
42
43
44
45
46
47
48
49
50
51
52
53
54
55
56
57
XI
XIII

TROUSERS

The present invention relates to trousers.

It is known that a pair of trousers comprises four flat side-pieces of a special out joined together by stitching. Each trouser leg is formed by parts of two of these side-pieces, which parts are joined together by side stitching and each of which has a longitudinal crease, one of these creases being disposed at the front of the leg and the other at the back. As a result, when the pair of trousers is not being worn, the legs may be flattened.

However, these known trousers have disadvantages. Their flat legs are not, in fact, specially made to assume the tubular shape necessary to surround the legs of persons wearing trousers. Therefore, when it is desirable for such trousers to be comfortable it is necessary to make the legs excessively wide. In this case the legs become deformed, lose their shape and their appearance is not impeccable when they have been worn. If the legs are made narrower they are less comfortable and the creases at the front and back always have a tendency to open and disappear which also has a detrimental effect on appearance.

It is an object of the present invention to provide a solution to these disadvantages. The invention relates to a pair of trousers which are very comfortable for the person wearing them and retain their appearance well.

The present invention provides a pair of trousers, each leg of which has a plurality of ribbed creases extending generally longitudinally along its periphery.

As a result of their relative rigidity, the ribbed creases tend to impart tubular shaping to each trouser leg especially when, as will very often be found desirable, each leg has at least three ribbed creases.

The ribbed creases may be formed, for example, by stitching flat a fold of fabric. The ribbed creases may follow sinuous, curved or other paths about their general longitudinal direction, but are preferably rectilinear.

The number and arrangement of the ribbed creases may be selected so as to give the legs of the trousers any desired cross-section, in particular rectangular, square, rhomboid or triangular cross-sections, or a cross-section of a rectangle with its corners cut-off. It is also possible to make trouser legs having longitudinal inwardly recessed pleats over the most part of their length, defined by said ribbed creases.

Several forms of trousers in accordance with the invention will now be described, by way of example, with reference to the accompanying drawings, in which.

Figures 1, 2, 3, 4:
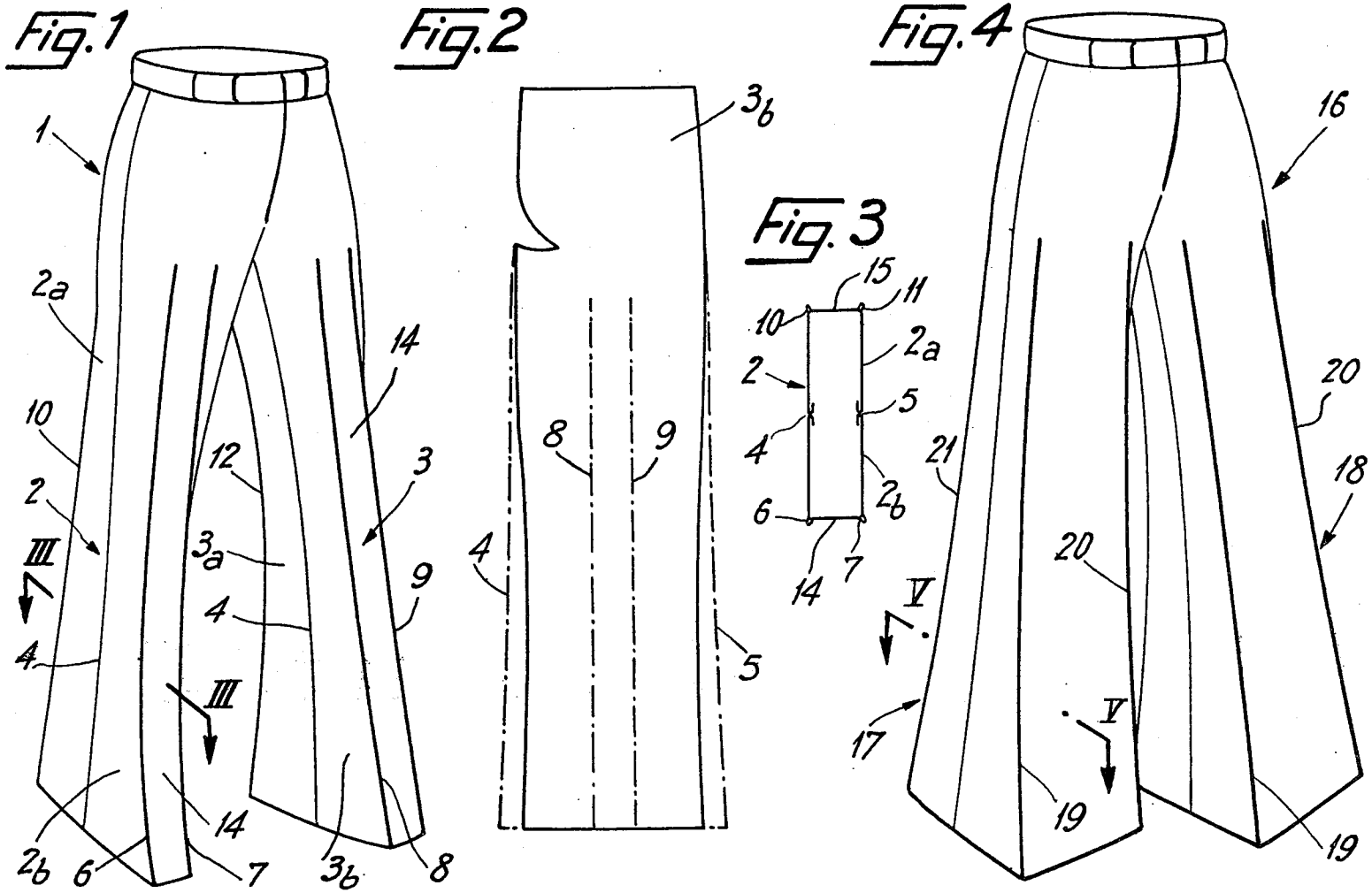
FIGS. 1, 4, 6, 8, 10 and 12 show perspective views of different forms of trousers.
FIG. 2 shows one side-piece for use in making the trousers of FIG. 1.
FIGS. 3, 5, 7, 9, 11 and 13 are cross-sections of legs of the trousers shown in FIGS. 1, 4, 6, 8, 10 and 12, respectively.

FIG. 1 shows a pair of trousers 1 in which each leg 2 and 3 is formed by two side-pieces 2*a* and 2*b*, 3*a* and 3*b* (see FIG. 3) joined together along two lines of stitching at the sides 4 and 5. Towards the front each leg has two ribbed creases 6 and 7 (or 8 and 9) parallel to, and approximately symmetrically disposed in relation to, the median vertical plane orthogonal to the plane passing through the seams 4 and 5 in each leg, i.e. approximately symmetric in relation to the vertical median plane mentioned above.

The ribbed creases 6 to 13 are such that their ridges are on the outside of the trouser legs. The result is that each leg 2, 3 has a rectangular cross-section (see FIG. 3) and is provided, at front and back, with facets 14 and 15 defined respectively between the ribbed creases 6 and 7, 8 and 9, 10 and 11, and 12 and 13. Such a pair of trousers therefore allows great freedom of movement whilst at the same time being of a width which is little different from that of trousers made as previously proposed.

FIG. 2 shows a solid-line representation of a side-piece, corresponding to the piece 3*b*, for making a known pair of trousers and the broken line shows the side-piece 3*b* of the trousers according to the invention as illustrated in FIGS. 1 and 3. It can be seen that, to obtain a pair of trousers according to the invention of the same width as a known pair of trousers, it is sufficient that, at least in the lower section, the sum of the lateral increases in the width of the side-piece 3*b* are approximately equal to the distance separating the ribbed creases 8 and 9.

The pair of trousers 16 shown in FIG. 4 is similar to the trousers 1, except that the legs 17 and 18 comprise four ribbed creases 19 to 22 defining tubes with an approximately square cross-section. (see FIG. 5).

Figures 5, 6, 7, 8, 9:
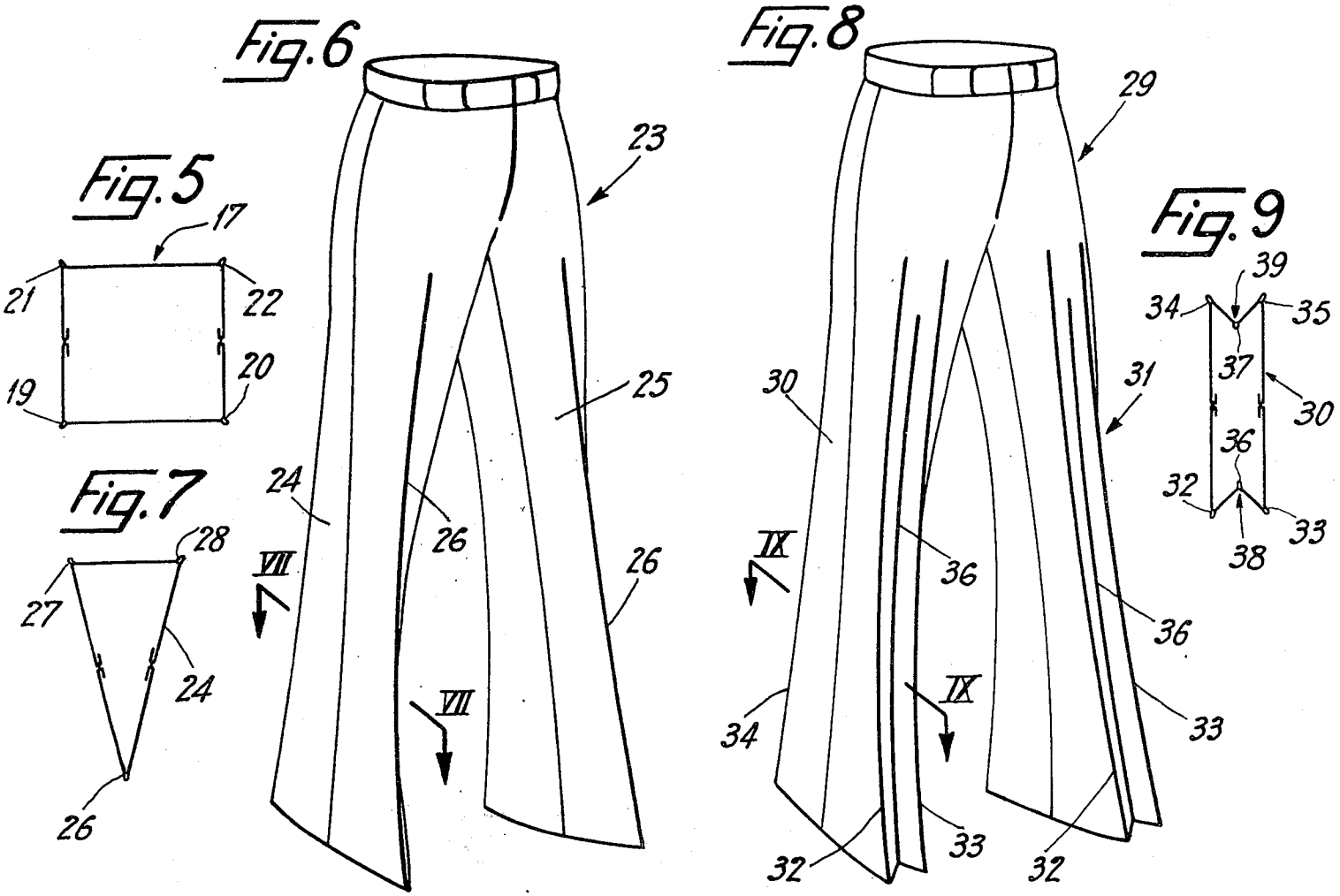

The trousers 23 shown in FIG. 6 are such that each leg 24 and 25 comprises a median ribbed crease 26 at the front and two parallel ribbed creases 27 and 28 at the back. The ribbed creases 26, 27 and 28 have externally-projecting ridges and they form legs 24 and 25 of a triangular cross-section (see FIG. 7). It would, of course, be possible for the trousers 23 to comprise instead two parallel ribbed creases at the front and a median ribbed crease at the back.

FIG. 8 shows a pair of trousers 29, each of the legs 30 and 31 of which comprises ribbed creases 32 and 35 with external ridges giving them a rectangular cross-section as in the trousers in FIG. 1. However, in the front and back facets defined respectively between the ribbed creases 32 and 33 on the one hand and 34 and 35 on the other hand, are provided median ribbed creases 36 and 37 with internally-projecting ridges. Two inwardly recessed pleats 38 and 39 are thereby obtained.

Although FIGS. 8 and 9 show a pair of trousers with recessed pleats it is obvious that the invention is also applicable in the case where the said inwardly recessed pleats project outwardly. In this case the ridges of the ribbed creases 36 and 37 would be on the outside of the legs 30 and 31.

Figures 10, 11, 12, 13:
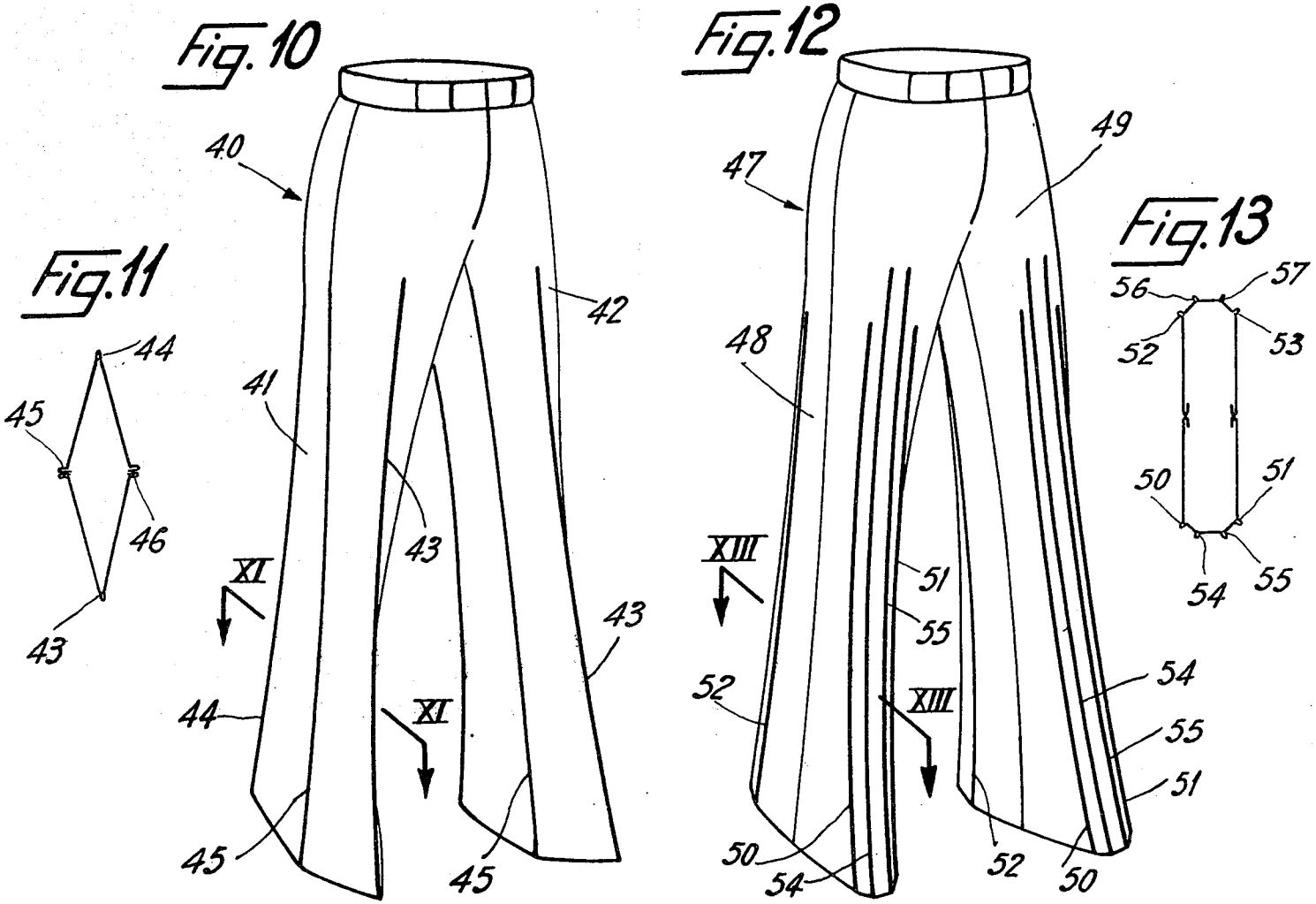

The trousers 40 shown in FIG. 10 are such that each of the legs 41 and 42 comprise four ribbed creases 43 to 46. The ribbed creases 43 and 44 are located on the median plane, one at the front of the leg and the other at the back, whilst the ribbed creases 45 and 46 are disposed laterally and coincide with the seam where the two side-pieces forming the said legs are stitched together. The legs of the trousers 40 therefore have a cross-section in the form of a diamond. (see FIG. 11).

FIG. 12 shows a pair of trousers 47 each leg 48, 49 of which comprises ribbed creases 50 to 53, with external ridges, giving them a rectangular cross-section as in the trousers of FIG. 1. However, in each of the front and back facets, defined respectively between the ribbed creases 50 and 51 on the one hand, 52 and 53 on the other hand, there are provided two ribbed creases 54, 55 and 56, 57 with externally-projecting ridges. Each leg 48 or 49 therefore has a rectangular cross-section with cut-off corners, as shown in FIG. 13.

It will of course be appreciated that modifications may be made in the means of production which have just been described, notably by substituting equivalent technical means, without going beyond the scope of the present invention, which is limited only by the appended claims.

I claim:

1. A pair of trousers comprising a pair of legs, each leg formed of only two side-pieces joined together along a line of stitching at the inseam and the outseam areas, each leg having at least three ribbed creases extending generally longitudinally along its periphery and comprising longitudinally extending ridges, and each leg having at least one inwardly recessed pleat extending generally longitudinally along the trouser leg and located between two adjacent ribbed creases.

* * * * *